US005755376A

United States Patent [19]

Greer et al.

[11] Patent Number: 5,755,376

[45] Date of Patent: May 26, 1998

[54] CONTAINER MADE FROM SINGLE FOLDABLE PANEL

[76] Inventors: Jerry A. Greer, 254 Corona Ave., Long Beach, Calif. 90803; Steve T. Josephson, 2628 E. 54th Huntington Park, Los Angeles, Calif. 90255

[21] Appl. No.: 684,306

[22] Filed: Jul. 17, 1996

[51] Int. Cl.[6] ..... B65D 3/02

[52] U.S. Cl. ..... 229/107; 220/615; 220/633; 220/669; 220/676; 229/4.5; 229/183; 229/198.2

[58] Field of Search ..... 229/107, 183, 229/198.2, 4.5, 400; 220/615, 633, 669, 676

[56] References Cited

U.S. PATENT DOCUMENTS

| | | | |
|---|---|---|---|
| D. 324,122 | 2/1992 | Brussing . | |
| D. 327,014 | 6/1992 | Heller et al. . | |
| D. 335,728 | 5/1993 | Dziersk et al. . | |
| D. 336,703 | 6/1993 | Mason, Jr. et al. . | |
| D. 355,514 | 2/1995 | Breen . | |
| 1,170,797 | 2/1916 | Burroughs . | |
| 2,068,763 | 1/1937 | Powell | 229/107 |
| 2,714,446 | 8/1955 | Gillam | 229/107 |
| 3,632,038 | 1/1972 | Souza . | |
| 3,701,181 | 10/1972 | Lock | 229/198.2 |
| 4,267,955 | 5/1981 | Struble | 229/400 X |
| 4,711,389 | 12/1987 | Alba et al. | 229/400 |
| 4,846,394 | 7/1989 | Swanson | 229/4.5 |
| 5,056,679 | 10/1991 | Lonczak . | |
| 5,065,886 | 11/1991 | Sher . | |
| 5,240,176 | 8/1993 | Akers . | |
| 5,365,022 | 11/1994 | Tipps . | |
| 5,372,269 | 12/1994 | Sutton et al. . | |
| 5,518,168 | 5/1996 | Mayer | 229/107 X |

*Primary Examiner*—Stephen P. Garbe
*Attorney, Agent, or Firm*—Longacre & White

[57] ABSTRACT

A multipurpose panel structure formed of a relatively thin resilient type material adaptable for use as a container device, the panel structure comprising a relatively flat one-piece wall member having a cooperatively engageable interlocking arrangement associated therewith enabling the wall member to be formed into an-open-ended closed wall structure capable of standing on end to form a container device, the cooperatively engageable interlocking arrangement providing an easily assembled yet stable container which may be shipped in its flat condition and later assembled without the need for special tools or equipment. The container assembly may take various shapes adaptable for holding a wide variety of materials including recyclable materials.

14 Claims, 1 Drawing Sheet

CONTAINER MADE FROM SINGLE FOLDABLE PANEL

BACKGROUND OF THE INVENTION a) Field of the Invention

The present invention relates generally to a container assembly for holding a wide variety of materials including recyclable materials such as promotional articles, recyclable aluminum cans, newspaper, cardboard and glass and/or plastic containers and, more particularly, to a multipurpose container assembly having a unique configuration which enhances ease of assembly and container stability.

b) Description of Related Art

In an office, store, merchandising or any other environment, many different types of containers are abundantly used for collecting and storing promotional articles and waste type materials including recyclable materials such as aluminum cans, glass and plastic containers, paper, cardboard and so forth. Many different types of containers have been constructed and used in the past in all types of environments sad for all types of applications. Typically, all such known prior art container devices are of a totally rigid, noncollapsible construction and, importantly, few of the known devices are designed to be transported in a disassembled state for ease of portability, while providing a design which is easy to assemble on-site. A totally rigid construction makes the known devices expensive to manufacture as well as bulky, awkward and difficult to transport from one location to another. There therefore exists a need for an inexpensive container assembly which can be easily and conveniently employed in a wide variety of environments, both indoors and outdoors, which container assembly can be stored and shipped in a compact, flat package and can be easily and readily assembled and disassembled by a single non-skilled person without tools and without external fasteners or other components.

Several prior art containers having been proposed which are formed from a foldable, resilient member. See U.S. Pat. No. 5,372,269 to Sutton et al. and U.S. Pat. No. 5,356,022 to Tipps. These prior art devices however are awkward to assemble, overly expensive to manufacture, and lack the stability necessary for a wide variety of applications.

While several prior art containers provide foldable panel structures formed from cardboard or resilient material, none of these prior art devices provide a foldable container having a bottom panel which is offset to form a recessed bottom portion to stabilize the container. Moreover, none of the prior art devices are designed with the elegance and ease of assembly required by this market.

SUMMARY OF THE INVENTION

The present invention teaches the construction and operation of a multipurpose container assembly wherein the container consists of a uniquely-shaped, foldable blank that can be stored, packaged and transported in substantially flat condition. A semi-cylindrical structure is formed from this single flat body panel that is made of a material that causes the panel to be somewhat resilient as well as somewhat biased towards its flat condition. When folded into a container, this semi-cylindrical structure has one closed bottom end and one open top end.

In its preferred embodiment, the present container assembly is comprised primarily of a single flat sheet of a resilient type material which is shaped and connected together to form an open-ended closed-wall panel structure, that can be uniquely formed into a semi-cylindrical shape. The blank can also be imprinted, embossed or otherwise decorated with indicia such as a company logo, promotional material, or other data. When not used, it is envisioned that the container assembly can be returned to its original flat condition. The foldable blank forming the present container can be packaged, stored and furnished in substantially flat form and they can be easily assembled and disassembled without tools or other means. Although the present container assembly is primarily designed for use in a business or commercial environment it can be utilized in any environment.

In its folded state, cooperatively engageable interlocking means are associated with each other at opposite sides of the body panel and at the bottom portion; the interlocking means enabling the respective end portions of the body panel to be locked together at adjacent side edges to form a novel semi-cylindrical wall shape or similar arrangement. The design of the cooperatively engageable means is such that, when the body panel is in its closed wall form and such means are engaged, the resilience of the body panel retains the body panel in the semi-cylindrical shape. The interlocking members are designed to securely lock together to maintain the structure's assembled state.

With this invention, the foldable body panel can be imprinted, embossed, engraved, etched or otherwise decorated with indicia and can be easily and simultaneously used as a sign to promote the sale of goods and/or services in a commercial setting to promote an activity or event, or to convey any particular message in an office or other environment. Because the foldable blank of this invention is easily manufactured and shipped, this enables a user to imprint a company logo, advertising promotional material, or any other message on the body panel and to display the same when the present device is utilized as a promotional or waste container. Since the body panel is made of a lightweight, preferably resilient or flexible, material as will be hereinafter explained, it can be easily manufactured, transported and assembled for use as a container assembly. The present assembly affords a user a simple arrangement to assemble, particularly, in a commercial environment where one is promoting and merchandising goods and/or services for short period of time with the constant need to replace one advertisement with another in a simple and inexpensive manner.

Another object of the invention is to provide a container having a uniquely recess bottom portion is integrally formed as part of the container and which locks in place to form a recessed bottom portion. With this arrangement the stability of the container is enhanced without sacrificing the ease of assembly or cost of the device.

These and other objects and advantages of the present invention will become apparent to those skilled in the art after considering the following detailed specification in conjunction with the accompanying drawings.

DETAILED DESCRIPTION OF THE INVENTION

Figure 2:
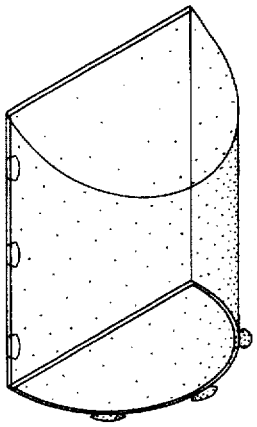
FIG. 2 is a perspective view of one embodiment of the present multipurpose container assembly constructed according to the teachings of the present invention.
Figure 3:
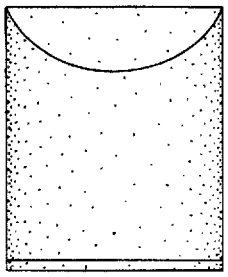
FIG. 3 is a front elevation view of the container assembly of FIG. 2.
Figure 4:
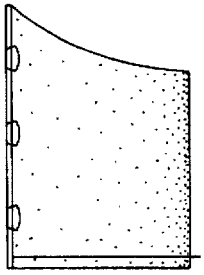
FIG. 4 is a side elevation view of the container assembly of FIG. 2.
Figure 5:
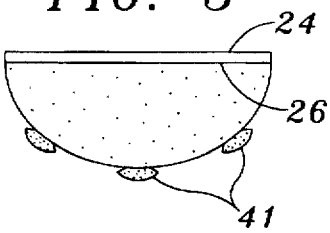
FIG. 5 is a top view of the container assembly of FIG. 2.

Referring to the drawings, FIG. 2 identifies one embodiment of a multipurpose container assembly constructed according to the teachings of the present invention. The container assembly 10 includes a body panel or wall member 20, the body panel 20 being formable into a closed-wall structure capable of standing on end to form a semi-cylindrical container 10 as shown in FIG. 2. The closed-wall structure of FIG. 2 is open at the top end 14 and closed at the bottom end 16.

Figure 1:
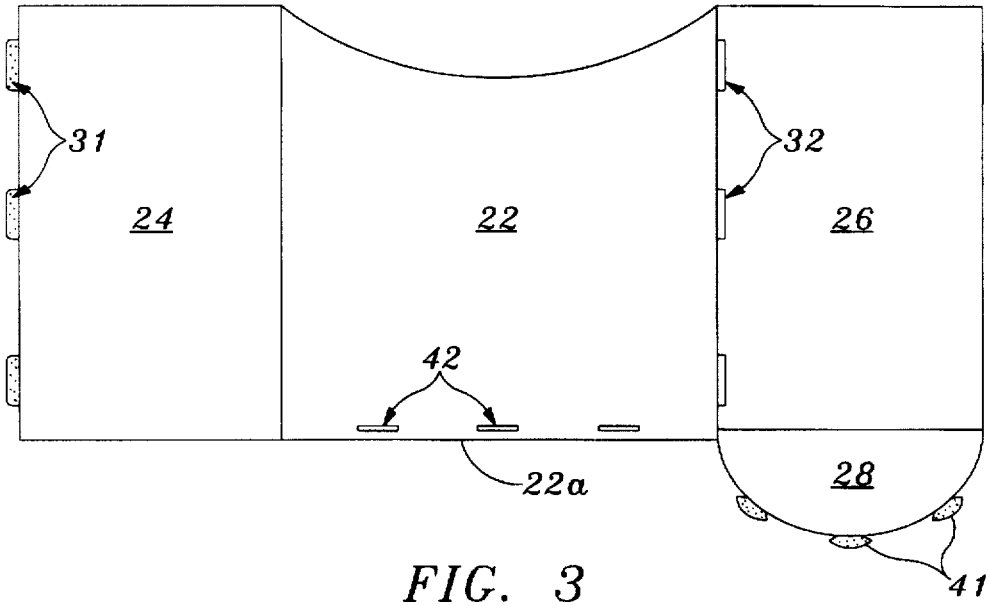
FIG. 1 is a plan view of the foldable panel member shown in its flat state.

The foldable body panel 20 is generally rectangular in shape as shown in FIG. 1 and is generally comprised of a one-piece resilient type material such as a thin sheet of resilient plastic, metal paperboard or other material including a thin wall or panel member made from recyclable materials. The member 20 includes a central portion 22 that defines the curved portion of the semi-cylindrical shape in is assembled state, and two wing members 24, 26 which overlap to define a flat back portion of the semi-cylindrical shape of FIG. 2. Furthermore, a semi-circular bottom member 28 is disposed along one end of the wing member 26. The semi-circular bottom member 28 has a fold line 29 which is offset from the adjacent edge **22*a* of the central portion 22; this offset fold line 29 helps to define the recessed bottom of the container assembly 10** of FIG. 2.

The body panel 20 described above is sufficiently flexible or resilient to enable it to be easily formed into the semi-cylindrical shape shown in FIG. 2 as will be hereinafter explained.

Cooperatively engageable interlocking means are associated with side edge portions of the body panel 20 for enabling such side edge portions to be interlocked together to form the semi-cylindrical body of FIG. 2. The cooperatively engageable means include a plurality of notches or openings 32 disposed along edge **26*a* of wing member 26 and a plurality of sidewardly extending tabs or projections 31 disposed along the edge portion 24*a* of the wing member 24 (see FIG. 1). The tabs and notches 31 and 32 respectively are preferably integrally formed with the body panel 20 and are correspondingly shaped to permit easy locking engagement with each other by any non-skilled person without the use of tools and without utilizing external fastening means or any other components. In this regard, each notch 32 includes elongated portions 30 which correspond in length to the overall length of the corresponding tab member 31. This means that each respective tab member 31 can be positioned through the elongated portions of each respective notch 32 such that the entire tab member 31 is inserted therethrough. This construction ensures that each tab member 31 will be fully and completely inserted within its corresponding notch 32** as will be hereinafter further explained.

Figure 6:
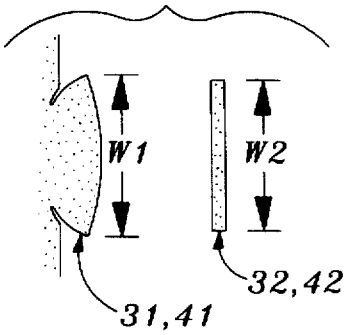
FIG. 6 is an enlarged partial perspective view of the cooperatively engageable interlocking means associated with the container assembly.

In the preferred embodiment of this invention, each tab member 31 is formed with a flared section **31*a* having a slightly larger width 'W1' than the notch 32 having width 'W2'. Thus, the flared section 31*a*** provides a locking engagement with the notch as best shown in FIG. 6.

It is also important to recognize that the tab members 31 should be inserted within the respective notches 32 as shown in FIGS. 2–5 from the outer surface 26' towards the inner surface 26" of the wing member 26 so that the tab members 31 end up lying against the inner surface 22' of the central member 22 in their coupled or joined condition. This is important not only from an aesthetic point of view, but also, more importantly, because such joinder maintains the cylindrical curvature of the body panel 20. In this regard, it is important that the body member 20 be made of a material that causes the panel member to be somewhat resilient and to be biased towards its flat condition. The design of the cooperatively engageable interlocking means 31 and 32 is such that, when the body panel 20 is interlocked in its semi-cylindrical form, the resilience of the body panel 20 creates a pressure that helps to retain the interlocking means 31, 32 in their engaged and locked condition. In other words, the resiliency or bias of the sheet material will tend to move the opposed side edges away from each other thereby holding and retaining the tab members 31 in their locking positions within the notches 32.

Interlocking members are also associated with the assembly and retention of the recessed bottom member 28 of the container 10 of this invention. Similar to the interlocking means described above, locking tabs 41 are integrally formed on the bottom member 28 and slots 42 are provided in the central portion 22. The slots 42 are aligned with the offset fold line 29 adjoining the bottom member 28 to the wing member 26. Due to the relative positioning of the offset fold line 29 and the slots 42, the bottom portion 28 forms a recessed bottom in the container in its assembled state. The interlocking members 41 are likewise formed with flared sections having a slightly larger width that the slots 42 to facilitate a secure engagement therebetween (see FIG. 6).

It should be understood that the flat body panel of this invention greatly facilitates transportation and easy assembly capability enhances portability from one location to another. It should also be recognized that various acceptable materials of construction are available and could equally be employed to fabricate the various components of the present invention. For example, the panel member could be made from any resilient type material as previously explained such as certain resilient, plastic materials, certain rubber-like materials, paper-board, certain metals and metal alloys as well as certain types of treated fabric materials so long as such materials are resilient or flexible enough to allow for sufficient bending of the panel members to achieve a cylindrical or other multi-sided form and such materials are of is sufficient rigidity to stand on end to form a container assembly. It is also recognized that a wide variety of cooperatively engageable joinder means other than the tab and notch arrangement illustrated in the accompanying drawings may be utilized to suitably fasten and attach the opposed side end portions of the various panel members into their closed wall form.

It is also important to note that the overall dimensions of the present container assemblies as well as the particular location and configuration of the various construction features associated therewith such as tab means 31, 41, and the openings and slots 32, 42, and panel sections 22, 24, 26 and 28 are subject to wide variations; each may be sized and shaped into a wide variety of different sizes and configurations; and each may be incorporated into any of the present panel members in any combination thereof without impairing the teachings and practices of the present invention. The durability, flexibility and versatility of the present multipurpose container greatly increases its usefulness and effectiveness in a wide variety of applications both indoors and outdoors.

The present invention therefore provides a multi-purpose panel structure which can be used as a container while at the same time promoting goods and/or services, or conveying any message of any kind. The construction and operation of a container assembly can be packaged, stored and shipped in a substantially flat condition, and can be easily assembled without the use of tools or other fastener means for assembling the same.

The container assembly is constructed of a relatively lightweight resilient material which is sturdy and able to withstand normal usage. This container assembly is relatively simple and easy to manufacture, ship and assemble.

While there has been shown and described several embodiments of a novel multipurpose container adaptable for use both indoors and outdoors which multipurpose devices fulfill all of the objects and advantages sought therefor, many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A panel structure formed of a relatively thin resilient type material for use as a container device for holding and collecting material, said structure comprising:

a foldable central portion defining an upper edge and a lower edge;

a first wing member integrally and pivotally formed with said central portion along a first fold line;

a second wing member integrally and pivotally formed with said central portion along a second fold line opposite from said first fold line with respect to said central portion;

a bottom member integrally and pivotally formed with said first wing member along a third fold line, said third fold line being parallel to and offset from said lower edge of said central portion, said bottom member further defining a bottom edge opposite said third fold line;

interlocking means for connecting an outer edge of said second wing member to a region adjacent to said first fold line, and for connecting said bottom edge to said central portion, wherein said panel structure is foldable from a substantially flat position to a folded position to define a closed-wall container having a closed bottom and an open top, and wherein said interlocking means comprises a first series of slots which are provided in said foldable central portion and which are aligned with said third fold line and a first series of tabs located on said bottom edge of said bottom member, in said folded position each tab of said first series of tabs passing through a corresponding one of said first series of slots provided in said foldable central portion and disposed perpendicular to said foldable central portion.

2. The panel structure of claim 1, wherein said interlocking means further comprises a second series of slots aligned along said first fold line.

3. The panel structure of claim 1, wherein said interlocking means further comprises a second series of tabs disposed along said outer edge of said second wing member.

4. The panel structure of claim 1, wherein said third fold line is perpendicular to said first fold line.

5. The panel structure of claim 1, wherein said second fold line is parallel to said first fold line.

6. The panel structure of claim 1, wherein said lower edge is perpendicular to said first fold line.

7. The panel structure of claim 1, wherein said panel structure defines a semi-cylindrical shape in said folded position.

8. The panel structure of claim 1, wherein said first series of tabs comprises a varying width to define a flared portion, said flared portion having a slightly greater width than a corresponding slot sized to receives each of said plurality of tabs.

9. The panel structure of claim 1, wherein said first wing member overlaps said second wing member in said folded position.

10. The panel structure of claim 1, wherein said first and second wing members retain a substantially flat planar shape in said folded position.

11. The panel structure of claim 1, wherein said central portion is folded into a arcuate shape in said folded position.

12. The panel structure of claim 1, wherein said bottom edge is arcuate in shape.

13. A panel structure formed of a relatively thin resilient type material for use as a container device, said structure comprising:

a foldable central portion defining an upper edge and a lower edge;

a first wing member integrally and pivotally formed with said central portion along a first fold line, said first fold line being perpendicular to said lower edge;

a second wing member integrally and pivotally formed with said central portion along a second fold line parallel to and opposite from said first fold line with respect to said central portion;

a bottom member integrally and pivotally formed with said first wing member along a third fold line, said third fold line being parallel to and offset from said lower edge of said central portion, said bottom member further defining a bottom edge opposite said third fold line;

interlocking tabs and slots for connecting an outer edge of said second wing member to a region adjacent to said first fold line, and for connecting said bottom edge to said central portion in a folded state of said panel structure, wherein said folded state of said panel structure defines a semi-cylindrical container having a recessed closed bottom and an open top, said open top being defined by said upper edge of the central portion and top edges of the first and second wing members, wherein said tabs for connecting said bottom edge to said central portion pass through said slots and lie in a plane defined by said bottom member to thereby project from and remain perpendicular to said central portion in said folded state of said panel structure.

14. The panel structure of claim 13, wherein, in said folded state, said central portion is folded into an arcuate shape and said first and second wing member maintain a substantially planar shape.

* * * * *